US005860254A

United States Patent [19]

Westhoff et al.

[11] Patent Number: 5,860,254

[45] Date of Patent: Jan. 19, 1999

[54] LIFT INSERT ASSEMBLY AND FABRICATION ASSEMBLY METHOD

[75] Inventors: James A. Westhoff, Langhorne; James A. Kelly, Reiglesville, both of Pa.

[73] Assignee: Poly-Tec Products, Inc., Tullytown, Pa.

[21] Appl. No.: 748,011

[22] Filed: Nov. 12, 1996

[51] Int. Cl.[6] ..... E04G 21/14

[52] U.S. Cl. ..... 52/125.4; 52/707; 52/122.1

[58] Field of Search ..... 52/122.1, 124.1, 52/124.2, 125.2, 125.3, 125.4, 125.5, 707, 709; 294/89, 1.1, 82.1, 82.24, 82.31

[56] References Cited

U.S. PATENT DOCUMENTS

| | | | |
|---|---|---|---|
| 3,705,469 | 12/1972 | Eriksson | 52/125.4 |
| 4,018,470 | 4/1977 | Tye | 294/89 |
| 4,087,947 | 5/1978 | Turner | 52/125.4 |
| 4,325,575 | 4/1982 | Holt et al. | 52/707 X |
| 5,560,711 | 10/1996 | Popp et al. | 52/707 X |

FOREIGN PATENT DOCUMENTS 1277847 10/1987 Canada .

*Primary Examiner*—Creighton Smith
*Attorney, Agent, or Firm*—Louis Weinstein

[57] ABSTRACT

A lift pin insert assembly is releasably mounted upon a mold member for casting a manhole section. The mold is filled with concrete, which surrounds and embeds the insert assembly in the cast member. The insert is configured to receive a lift pin, which is automatically moved to a locked position when lifting tension is applied. A reinforcing support assembly includes at least a face plate and a metal rod of suitable thickness at least partially encircling the insert, and anchored either to the face plate or an additional support plate. The support assembly distributes the forces applied by the lifting force to the cast member substantially uniformly over a large surface area, significantly increasing the weight load capable of being lifted by a given lift pin without increasing the size and/or diameter of the lift pin.

28 Claims, 4 Drawing Sheets

LIFT INSERT ASSEMBLY AND FABRICATION ASSEMBLY METHOD

FIELD OF THE INVENTION

The present invention relates to inserts provided in cast members for use with lift pins and the like, and more particularly to a novel insert assembly, incorporating a supporting structure which greatly increases the load lifting capability of a lift pin without altering its physical size and/or strength characteristics, as well as providing an advantageous fabrication and assembly method therefore.

BACKGROUND OF THE INVENTION

In the construction industry, it is not only well-known, but it is preferred that concrete structures and/or components be precast at the factory, and delivered to a job site for installation. Precasting has many advantages over in situ casting, the primary factors of which include the casting of components having greater precision and tighter tolerances, the consistency of product's specifications and reduced costs, which go hand-in-hand with use of mass assembly techniques as compared with one-at-a-time in situ casting.

Nevertheless, precast concrete structures of sizable dimensions are quite heavy, in many cases weighing thousands of pounds. For example, conventional precast manhole sections typically range in weight from 2,000 to 8,500 pounds each, necessitating the use of mechanical lifting and moving equipment.

Apparatus employed in one preferred technique for handling precast manhole sections is described in U.S. Pat. No. 4,088,361, which is incorporated herein by reference thereto. As is described therein, precast manhole sections are each provided with plastic inserts, which are releasably mounted upon an outer wall of a mold assembly in which a manhole section is cast so as to be embedded into the cast member.

The plastic insert has a cavity of a predetermined shape configured to receive a lift pin. Two such insert assemblies are provided in each cast member, being arranged diametrically opposite one another.

A lift pin is inserted into each insert. A lifting apparatus for lifting and moving the precast section, applies lifting tension to the lift pins, which cause the pins to rotate 90° from an initial horizontal position to a vertical position where they become locked within the inserts and hence the cast member to assure that the pins are not dislodged during lifting and movement of the precast member to assure that these operations are performed in a safe manner.

When the precast member is delivered to the desired location, for example, upon the flat bed of a truck for delivery from factory to installation site, the lifting mechanism, after depositing the cast member upon the flat bed, is lowered, which relaxes the lifting tension at which time the lift pins may be rotated from the vertical to the horizontal position for easy removal.

Although concrete has a maximum compressive strength of 4,000 PSI, as the diameter and wall thickness of manhole sections increases, the cantilever forces developed by the lift pin and exerted upon the lift pin insert and hence the cast member increase in magnitude due to the increased weight of the cast member which causes the cast material to fracture.

One technique which has been employed by the Applicant for increasing the structural supporting strength of the insert is to wrap a rebar about the periphery of the plastic insert so that the rebar forms a substantially V-shaped configuration with a loop being provided about the plastic insert at the apex of the V-shaped rebar. This arrangement has provided only a small improvement in the amount of load which a cast member can withstand before fracturing.

In addition, it is extremely advantageous to provide lift pin and insert assemblies which are usable in cast members having a wide range of weights and sizes, thereby reducing, if not substantially eliminating, the need to provide a large inventory of lift pins of different sizes to accommodate the lifting and handling of cast members of different sizes and weights.

BRIEF DESCRIPTION OF THE INVENTION

The present invention provides an insert assembly and method of fabrication and assembly therefor, which incorporates all of the advantageous features and objectives set forth hereinabove, and is characterized by comprising a plastic insert of conventional design utilized together with an assembly which supports the plastic insert and includes a faceplate arranged to be substantially flush with an outer periphery of the cast member. In one preferred embodiment at least one rebar is secured to the faceplate, preferably by welding, and encircles and preferably either engages or lies in close proximity to the underside of the insert.

The orientation of the plastic insert, and the manner in which the lift pin inter-engages and locks with the insert is substantially the same as in a conventional design described, for example, in U.S. Pat. No. 4,088,361 so that, when a cast member is lifted, the lift pins tend to pivot in a direction so that their free ends are urged downwardly by the weight of the cast member whereby the forces exerted upon the cast member due to the lifting thereof are distributed over the face of the faceplate engaging the cast member as well as the rebar assembly, which prevents deplaning, i.e. separation of the cast material from the faceplate. The insert assembly also prevents fracturing of the cast material, thus enhancing its structural integrity, assuring a long, useful operating life.

The hollow, plastic insert has an internal shape which is specifically adapted to receive the free end of the lift pin, and to positively seat a projection at the free end of the lift pin wherein the lift pin is automatically moved to a locking position when lifting tension is applied thereto. The lift pin is ultimately removed by rotating in the opposite direction after the lifting tension is removed.

In one preferred embodiment, the support assembly for the plastic insert receiving the lift pin is preferably fabricated independently of the plastic insert, after which the plastic insert is placed in the support assembly to protect the plastic insert from damage or distortion due to the heat generated during welding operations employed to join the rebar and faceplate.

In another preferred embodiment, the insert support assembly is provided with an additional support plate welded to and extending from the faceplate. A rebar is welded to the faceplate and/or the support plate, and is bent or otherwise shaped, either independently or in combination with the support plate, to substantially encircle the plastic insert. The size of the space encircled by the rebar or the rebar and support plate is sufficient to assure proper placement of the plastic insert within the support assembly after welding of the support elements. The support plate may be positioned so that a plane passing through a major face thereof is either horizontally or vertically aligned when the assembly is placed into and ultimately embedded in a cast member after it has set. The vertical orientation of the support plate assures more uniform distribution of the cast material, and prevents the formation of bubbles, and/or air pockets in the region of the insert support assembly.

The support assembly, with the plastic insert properly positioned therein, is mounted upon a mold member, and is releasably secured thereto by means of a releasable locking member, which holds the insert and its support assembly in the proper position during casting, and which is removed when the cast member is set.

The insert support assembly provides enhanced structural strength and integrity for cast members over a wide weight range to be safely lifted and handled by lifting equipment using a lift pin of a given size, strength and dimension, which is capable of safely lifting cast members over a size and weight range whose upper end is over 8,000 pounds, thus greatly simplifying the number of lifting components required for safely handling and lifting the aforesaid wide range of cast members.

OBJECTS OF THE INVENTION

It is therefore one object of the present invention to provide a novel support assembly for lift pin receiving inserts employed in cast members and the like.

Still another object of the present invention is to provide novel support assemblies for plastic inserts employed in cast members to permit such cast members to be safely lifted and handled by lift pins whereby the insert support assemblies permit lifting of cast members over a weight range not heretofore possible through the use of conventional inserts and/or support assemblies.

Still another object of the present invention is to provide novel support assemblies for plastic inserts for lift pins, which provide greater, more even distribution of compressive forces within the cast member to permit lifting and handling of cast members at weights not heretofore possible through the employment of conventional apparatus.

Still another object of the present invention is to provide novel support assemblies for plastic inserts for lift pins utilizing a metallic support structure comprised of a faceplate, and a member joined to said faceplate for supporting the plastic insert, and hence a lift pin inserted therein during lifting to assure safe lifting of the cast member without damaging or fracturing the cast material.

Still another object of the present invention is to provide a novel method for fabrication of plastic insert support assemblies to protect the inserts from damage.

BRIEF DESCRIPTION OF THE FIGURES

The above, as well as other objects of the present invention, become apparent upon consideration of the following description and drawings in which.

DETAILED DESCRIPTION OF THE INVENTION AND PREFERRED EMBODIMENTS THEREOF

Figure 1B:
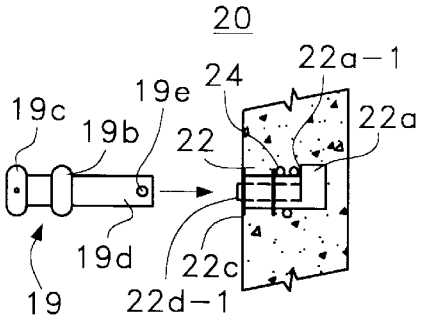
FIGS. 1*b*–1*e* are figures useful in explaining the manner in which a lift pin is locked into position within an insert assembly, FIGS. 1*b* and 1*d* showing side views, partially sectionalized of a lift pin and an insert assembly, and FIGS. 1*c* and 1*e* respectively showing front views of FIGS. 1*b* and 1*d*.
Figure 1C:
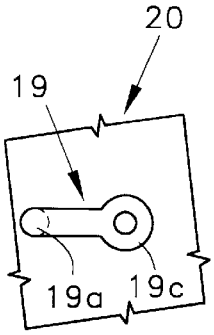
Figure 1:
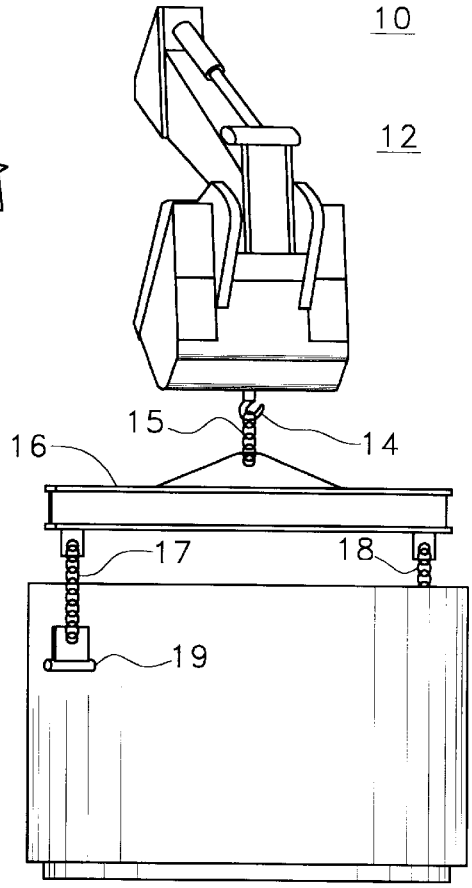
FIG. 1 shows a perspective view of a cast member, incorporating the apparatus of the present invention, and the manner in which the cast member is lifted and handled.

FIG. 1 shows apparatus 10 for lifting and handling cast member 20, said apparatus comprising a conventional mechanism 12, such as a crane, for lifting and moving the cast member 20. Obviously any other lifting and moving apparatus may be utilized such as overhead cranes and the like. The lifting and moving apparatus 12 may comprise a hook 14. A short section of chain 15 is suspended on hook 14, and has its lower end supporting a spreader bar 16. A pair of chains 17 and 18 are supported at opposite ends of bar 16. The lower ends of the chains are each secured to a lift pin 19, only one of which is shown in FIG. 1.

Figure 1D:
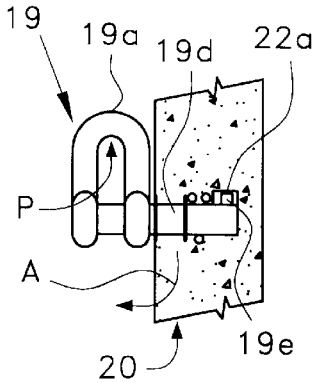
Figure 1E:
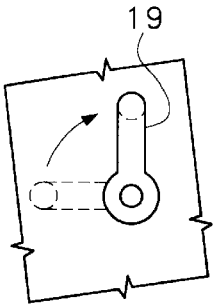
Figure 1A:
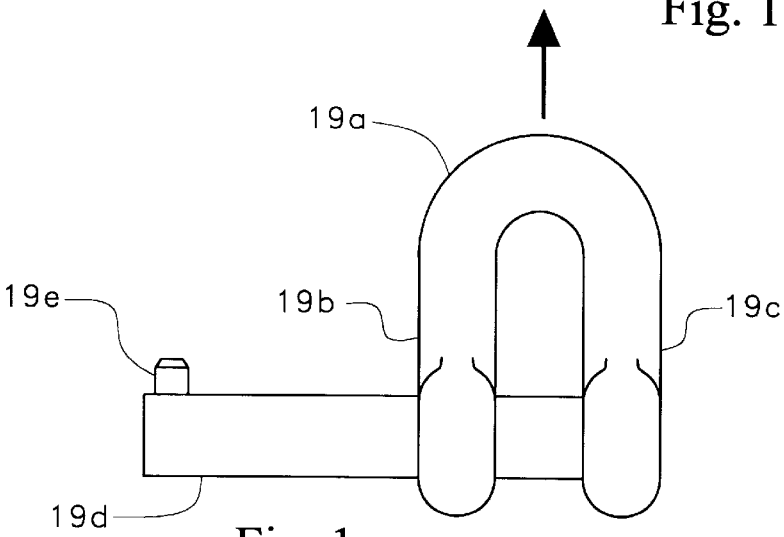
FIG. 1*a* is a plan view of a lift pin usable with the insert assembly of the present invention.

FIG. 1*a* shows a typical lift pin 19 in greater detail. The lift pin is comprised of a substantially U-shaped portion 19*a*. The free ends of the arms 19*b* and 19*c* of U-shaped portion 19*a* are each provided with openings for receiving a cylindrical shaped rod 19*d* welded or otherwise secured to U-shaped portion 19*a*. The free end of rod 19*d* is provided with a pin 19*e*, which extends at a right-angle from rod 19*d*.

The lift pins 19 are each inserted into an associated plastic insert (not shown in FIG. 1). The manner of insertion and locking will be described hereinbelow. The inserts are arranged about the outer periphery of cast member 20, and are diametrically opposed to one another.

FIGS. 1*b* and 1*c* respectively show a sectional view and an end view of a plastic lift insert 22 embedded within cast member 20. A reinforcement loop 24 formed of a No. 3 rebar encircles the insert to provide added reinforcement for the insert during lifting. A No. 3 rebar is a rod typically formed of a suitable metal such as steel and having a diameter of ⅜ inches.

Lift pin 19 is aligned for insertion so that its U-shaped portion lies in a substantially horizontal plane. Lift pin is moved into insert 22 until the free end thereof provided with pin 19*e* abuts against the inward end of insert 22. The lift pin 19 is oriented in the position shown in FIG. 1*c*.

When lifting tension is applied to each lift pin 19, the lift pins rotate from the position shown in FIGS. 1*b* and 1*c* to the position shown in FIGS. 1*d* and 1*e* whereby the U-shaped portion 19*a* of lift pin 19 is rotated clockwise to the vertical position. The projection 19*e* is locked into the projection receiving portion 22*a* of insert 22, retaining the lift pin in the locked position during lifting and handling of cast member 20. The details of the lift pin insert 22 are shown in U.S. Pat. No. 4,088,361 and are omitted herein for purposes of brevity.

Insert 22, in addition to providing locking of the lift pin 19 during lifting and handling of the cast member 20, provides a watertight and economic means for handling precast members such as manholes and other concrete structures. The insert is preferably compounded from polypropylene, and is fabricated in such a manner that a predetermined thickness of concrete forms a barrier to prevent infiltration of water into the structure. The insert is installed during the casting process, and forms an integral of the cast member. If desired, the insert may be formed of any other plastic material exhibiting the desirable characteristics of polypropylene.

The shape of the cavity 22*a* receiving the projection at the end of the lift pin assures minimum movement of the lifting device during handling, as well as locking the lifting device during lifting and handling.

Figure 5A:
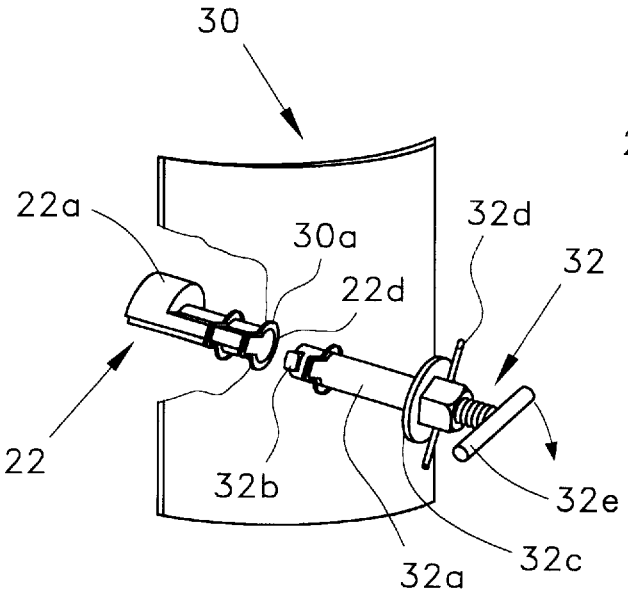
FIGS. 5*a* and 5*b* are perspective views showing the manner in which an insert is mounted to a mold member for embedment in a cast member.
Figure 5B:
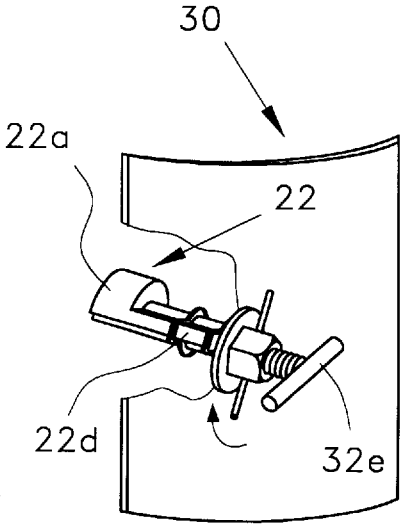

FIGS. 5*a* and 5*b* show the manner in which the insert is integrated into the cast member.

FIG. 5*a* shows a portion of an exterior mold member 30 having a keyhole-shaped opening 30*a* for receiving inserts 22. Insert 22 is positioned along the interior concave surface of the mold member 30, and is aligned with opening 30*a*. A flange 22*c* rests against the concave surface. The end portion 22*d*-1 of the spline 22*d* of insert 22, which projects beyond flange 22*c*, extends into the square-shaped portion of the keyhole-shaped opening 30*a*. A steel pin 32*a* forming part of a locking assembly is aligned with opening 30*a* and insert 22, and is moved into the insert so that its projection 32*b* is aligned with the spline portion 22*d* of the keyhole-shaped opening of the insert.

Pin 32*a* is moved to the position where flange 32*c* engages the exterior surface of mold member 30. Pin 32*a* is then rotated 180° by manipulation of the operating handle 32*d*, moving projection 32*d* into a locking position within projection receiving cavity 22*a* of insert 22. Wing nut 32*e* is then tightened to secure the insert into position whereupon the cementitious material, i.e. concrete, is poured into the assembly mold. Techniques such as vibration are preferably utilized to cause the cementitious material to be compact and evenly distributed throughout the mold interior, and to prevent the formation of air pockets and/or bubbles.

When the cast material has set, wing nut 32*e* is loosened, pin 32*a* is rotated counterclockwise through 180°, and is removed from the cast member.

When the cast member is removed from the mold, and has been adequately cured, the inserts may be utilized in the manner described hereinabove for lifting and handling operations.

When a cast member is lifted in this manner, each lift pin tends to pivot. For example, lift pin 19, shown in FIGS. 1*d* and 1*e*, tends to pivot in a clockwise direction about a pivot point P, the direction which the pin tends to pivot being shown by arrow A.

The weight of the cast member is counteracted by the compressive force of the cast material, such as concrete.

Concrete has a compressive strength of 4,000 PSI. For a lift pin of a given size, the weight of a cast member which can be lifted thereby is limited, necessitating a larger lift pin as the cast member increases in wall thickness and weight, requiring that fabricators inventory a wide range of lift pins, and cooperating inserts in order to be able to handle cast members over a wide range of sizes, thereby increasing both the costs and complexity involved in the fabrication and handling of cast members having lift pin inserts.

The present invention significantly increases the weight range of cast members which a lift pin of a given size and strength is capable of lifting through the employment of a novel support assembly as will be described hereinbelow.

Figure 2:
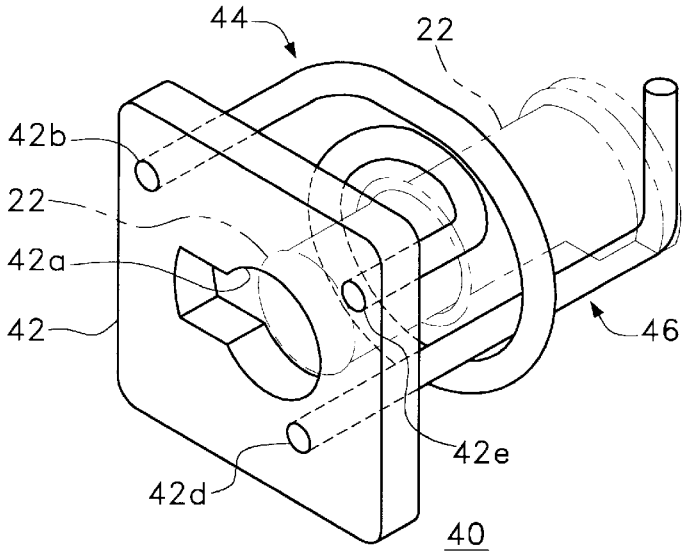
FIG. 2 is a perspective view showing one preferred embodiment of the insert support assembly of the present invention.
Figure 2A:
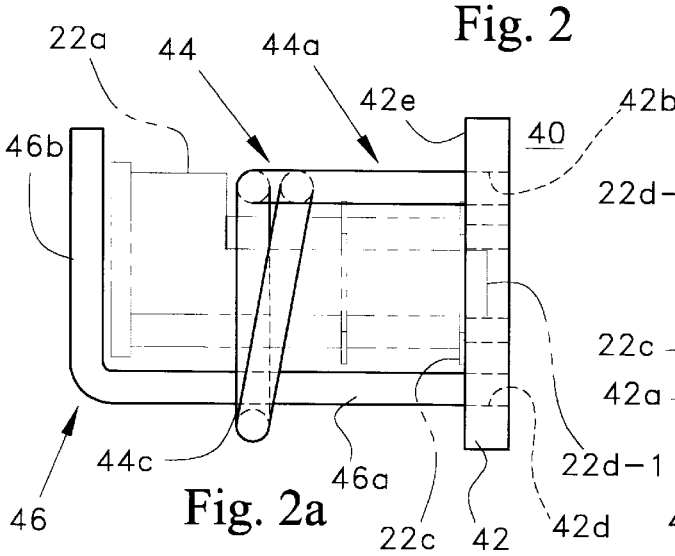
FIG. 2*a* shows a side view thereof, partially sectionalized.
Figure 2B:
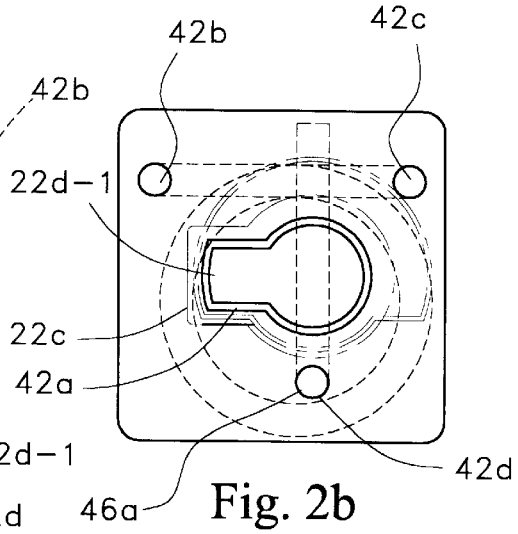
FIG. 2*b* is a front view of FIG. 2*a*.

FIGS. 2, 2*a* and 2*b* show one preferred embodiment of a support assembly 40 comprised of a faceplate 42 of a substantially rectangular-shape having a keyhole-shaped opening 42*a*, the squareshaped portion thereof receiving and positioning spline portion 22*d*-1 of the forward, open end 22*b* of insert 22.

Openings 42*b*, 42*c* and 42*d* are provided for receiving the free ends of rebar members 44 and 46.

Rebar member 44 has an intermediate portion thereof bent or otherwise formed into a loop 44*c* of at least one full turn adapted to encircle insert 22 in the manner shown. The free ends of the looped rebar 44 are formed into a pair of substantially parallel anchoring portions 44*a* and 44*b*, are respectively inserted into the openings 42*b* and 42*c*, and are secured thereto, preferably by welding.

The substantially L-shaped rebar 46 has a first arm 46*a* extending along the underside of insert 22. The free end thereof is inserted into opening 42*d* and, in one embodiment is secured thereto preferably by welding. The remaining arm 46*b* extends along and lies adjacent to the left-hand end of insert 22. Arm 46*a* lies within the one turn loop 44*c* and along the underside of insert 22.

The insert support assembly and plastic insert are held in position within the mold assembly substantially in the same manner as was described hereinabove with regard to the insert per se. The faceplate 42 is positioned along the concave inner periphery of an outer mold member. The mold member is provided with a keyhole-shaped opening conforming to the openings in the insert 22 and faceplate 42.

In the embodiment shown, the rebars 44 and 46 encircle the insert in such a manner as to require that the insert be placed within the rebars before the welding operation. The welding operation creates a significant amount of heat which is conducted to the insert by the metallic members 42, 44 and 46 which results in damage and/or distortion of the insert, often rendering it unusable.

One technique for protecting the plastic insert is to weld the ends of rebar 44 to faceplate 42, and to fabricate opening 42*d* to provide a tapped opening and provide arm 46*a* with a threaded end for threadedly engaging tapped opening 42*d*, enabling the insert to be placed inside loop 44*c* and its free end against opening 42*a*, after rebar 44 is welded to faceplate 42, and thereafter inserting and threadedly engaging rebar 46 with the tapped opening 42*d* and faceplate 42.

Another technique which may be utilized to protect the plastic insert is to increase the interior diameter of the loop 44*c* to permit insert 22 to be inserted at an angle to a central axis aligned with the center of the loop provided for encircling the insert and then properly aligned with opening 42*a* after the left-hand end of the insert is clear of arm 46*b* of rebar 46.

Still another technique for protecting the insert 22 is to form the material capable of withstanding the heat generated during welding such as.metal or a suitable plastic.

When cast member 20, having the inserts 22 and lift assembly 40 embedded therein, is lifted by a pair of lift pins 19, the internal forces exerted by the concrete are distributed over the entire area of the left-hand surface 42*e* of faceplate 42 as well as the entire surface area of the rebars 44 and 46.

The weight of the cast member 20 acts to urge the pin 19*d* downwardly causing this force to be applied to insert 22 and hence rebars 44 and 46. Rebars 44 and 46 are supported by faceplate 42 being rigidly secured thereto. The significantly increased surface area of the interface between the insert support assembly and the concrete significantly reduces the concentration of forces acting upon the concrete enabling the employment of a given size lift pin for lifting cast members over a significantly broader range of sizes and weights.

For example, a lift pin capable of safely lifting cast members of a maximum weight of 4,500 pounds when using conventional inserts and reinforcement techniques, is capable of safely lifting cast members of up to 8,200 pounds when employing the insert support assembly of the present invention, thus eliminating the need for a wide range of lift pins otherwise required to lift and handle the cast members over a broad range of sizes and weights. Rebars of a greater diameter such as a No. 4 rebar (having a diameter of 7/16 inches) can be substituted together with a larger size insert for handling cast members of sizes and weights beyond the range set forth above.

In addition to the above, the insert support assemblies of the present invention are relatively simply to fabricate, and are formed of components which are inexpensive and easy to obtain, thus significantly reducing the cost of such inserts while retaining all of the distinct advantages described hereinabove.

Figure 3A:
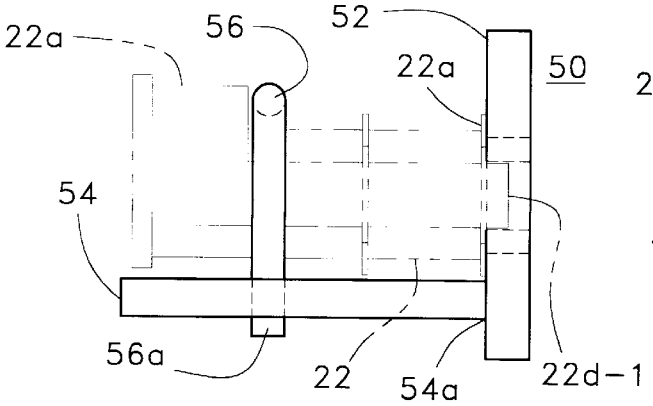
FIG. 3*a* is a side view showing a second preferred embodiment of the insert support assembly of the present invention.
Figure 3B:
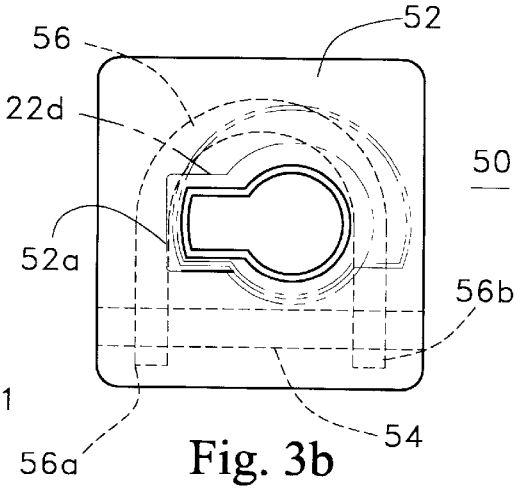
FIG. 3*b* shows a front view thereof of the embodiment of FIG. 3*a*.

FIGS. 3*a* and 3*b* show still another embodiment 50 of the present invention comprised of a faceplate 52 similar to faceplate 42, and having an opening 52*a* similar to opening 44*c*.

A support plate 54, formed of a piece of flat stock, has its right-hand end 54*a* engaging and welded to a lower end of faceplate 52. Support plate 54 is provided with openings 54*b* and 54*c* respectively receiving free ends of a substantially U-shaped rebar 56, the rebar 56 being welded to plate 54 after insertion. Rebar 56 cooperates with plate 54 to encircle insert 22 and rests against the right-hand, exterior surface of the pin receiving and locking portion 22*a* of insert 22, as shown. The upper major face 54*d* of plate 54 is positioned beneath the underside of insert 22. The increased surface area between the surfaces of members 52, 54 and 56, and the concrete serve to distribute the counteracting forces over a larger surface area, providing significantly increased supporting strength and, similar to the embodiment 40, enables the use of a lifting pin for lifting cast members having sizes and weights over a significantly wider range, similar to that of the embodiment 40.

Figure 4:
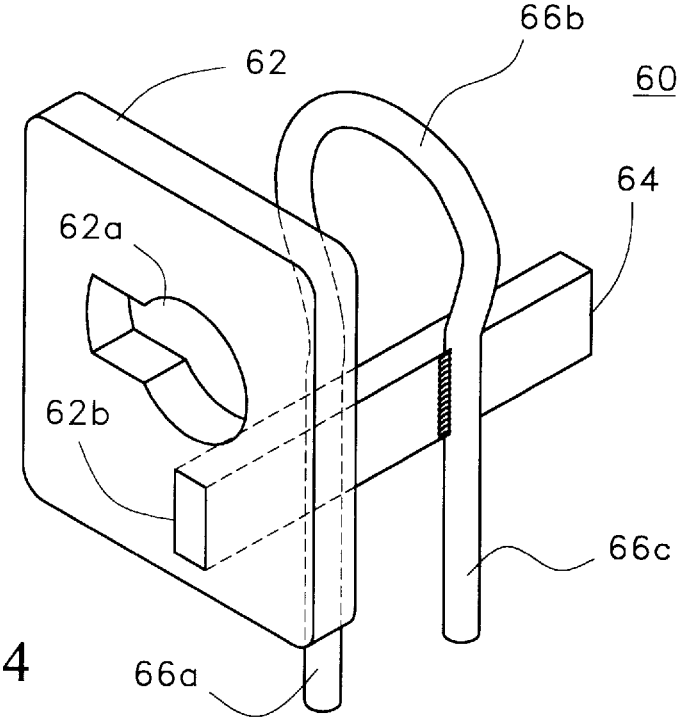
FIG. 4 is a perspective view showing a third preferred embodiment of the insert support assembly of the present invention.

FIG. 4 shows a perspective view of another embodiment 60 of the present invention comprised of faceplate 62, insert support plate 64 and rebar 66, with the insert omitted. Faceplate 62 has a keyhole-shaped opening 62*a* similar to that shown in the faceplates of the embodiments 40 and 50, for receiving the open end of the plastic insert 22. Plate 64, which may be formed of a piece of flat stock, has one end inserted into an opening 62*b* in faceplate 62, and is preferably welded thereto.

Rebar 66 is bent into a substantially U-shaped configuration, having mid portions of the arms 66*a* and 66*b* welded to opposite major faces of the support plate 64, as shown.

The yoke portion 66*b* of rebar 66 has an enlarged diameter and cooperates with plate 64 to substantially encircle an insert 22 placed within the opening formed by members 64 and 66. The faceplate 62, support plate 64 and rebar 66 are initially assembled and welded at the places shown, and the insert 22 is positioned within the assembly after fabrication and cooling thereof to protect the plastic insert from being damaged or distorted due to the heat conducted through the metallic members 62, 64 and 66 during welding thereof. The edge 64*a* of plate 64 lies beneath insert 22.

The embodiment 60 provides all of the advantages of the embodiments 40 and 50 as well as the additional advantages of providing greater supporting strength for insert 22 due to the vertical orientation of plate 64 as well as providing greater structural strength between the joined members 62 and 64 due to the fact that the plate 64 is able to withstand significantly greater forces exerted in a downward, vertical direction as compared with support plate 54, which is horizontally aligned.

The flow of concrete around the members 22, 54 and 56 in the embodiment 50 of FIGS. 3*a* and 3*b*, as the concrete flows upward during filling of a mold assembly, tends to block the flow causing "slabbing"(i.e. the concrete does not adhere to the metal and "slabs" off). The orientation of the member 64 promotes significantly improved flow of concrete about members 62, 64 and 66, thus preventing "slabbing".

In addition to the above, the vertical orientation of plate 64 assures more even and thorough flow of the cast material between and around the members 22, 62, 64 and 66 during the initial stages of casting to further protect against the formation of air bubbles and/or air pockets.

Figure 6A:
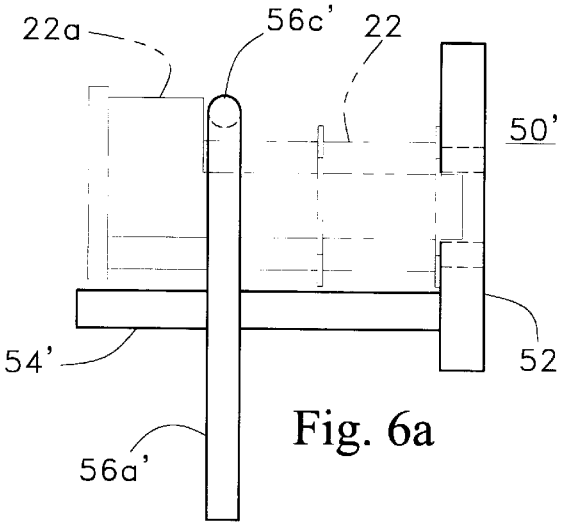
FIGS. 6*a* and 6*b* show side and front views of another preferred embodiment.
Figure 6B:
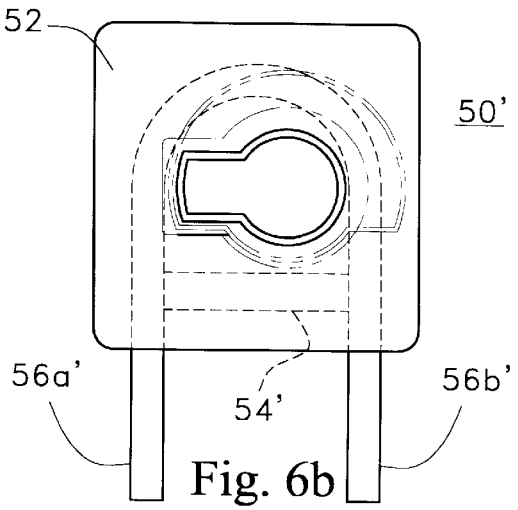

FIGS. 6*a* and 6*b* show still another preferred embodiment 70 of the present invention wherein like elements as between FIGS. 3*a* and 3*b* are designated by like numerals, and only the differences in the new embodiment will be described hereinbelow.

The faceplate 42 has a keyhole-shaped opening 42*a*, the square-shaped portion thereof receiving and positioning the spline portion 22*d*-1 at the forward, open end 22*b* of insert 22.

Support plate 54 formed of a piece of flat stock has its right-hand end 54*a* adjoining the lefthand surface of faceplate 42. These adjacent surfaces are welded to one another.

A substantially U-shaped rebar 56' is positioned so that support plate 54 spans between the arms 56*a*' and 56*b*' of rebar 56'. The rebar 56' is positioned so that its curved portion is arranged in a manner similar to that of the curved portion of the rebar 56 shown in FIG. 3*b* to enable the insert 22 to be positioned within the area encircled by rebar 56' and support plate 54 in order to permit the components 52, 54 and 56' to be welded to one another prior to insertion of insert 22 to protect insert 22 from damage due to heat generated during the welding process. The support plate 54 has its side edges 54*b*, 54*c* welded to adjacent arm portions of rebar 56' as shown best in FIG. 6*b*.

The support assembly 70 of FIGS. 6*a* and 6*b* has all the advantages of the support assembly 50 shown in FIGS. 3*a* and 3*b* and provides additional support against twisting or turning of the support assembly due to the increased length of the arms 56*a*', 56*b*', which are embedded in the cast material.

Figure 7A:
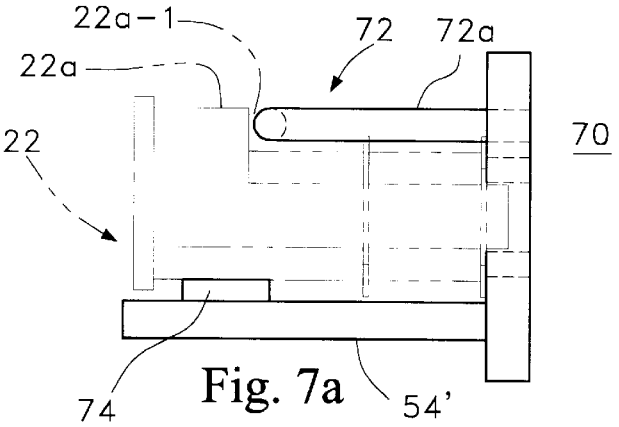
FIGS. 7*a* and 7*b* show side and front views of still another preferred embodiment.
Figure 7B:
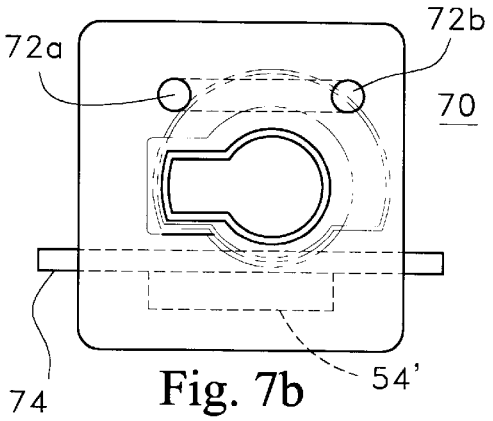

FIGS. 7*a* and 7*b* show still another embodiment 80 in which like elements as compared with FIGS. 6*a* and 6*b* are designated by like numerals. Only the different features of the support assembly 80 will be described hereinbelow for purposes of simplicity.

Comparing the support assembly 80 with the support assembly 70, rebar 56' is omitted and a small piece of flat stock 82 is positioned closer to the free or left-hand end of support plate 54 and is welded thereto. The undersurface of insert 22 rests upon the upper surface of small flat plate 82.

A substantially U-shaped rebar 84 has its arms 84*a*, 84*b* extending in a direction of face plate 52 and the free ends thereof are welded thereto. The curved portion of rebar 84 is positioned to engage the vertical external surface 22*a*-1 of end portion 22*a* of insert 22. The arrangement of the support assembly 80 enables the insert 22 to be placed in the position shown in FIGS. 7*a* and 7*b* after the welding operations performed to join the components 52, 54, 82 and 84. Support plate 54 and rebar 84 both serve to prevent twisting, turning or deplaning of the support assembly when a cast member in which the support assembly is embedded is lifted by a pair of lift pins.

All the embodiments of the present invention described hereinabove share the advantages which have already been set forth, namely the provision of an insert support assembly of significantly increased structural strength as compared with convention insert assemblies enabling to use lifting pins of a smaller size as compared with conventional insert assemblies as well as enabling use of a lift pin of a given size to be utilized over a wider size and weight range of cast members as well as being capable of being simply, and easily fabricated from inexpensive materials.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. In combination, a cast member, a hollow insert and a support assembly embedded in the cast member for supporting said hollow insert, which insert receives and secures a lifting pin, comprising:

a faceplate having an opening aligned with an opening in said insert, said faceplate opening and said insert opening lying along an exterior surface of said case member to facilitate insertion of the lifting pin;

means encircling an intermediate portion of said insert, said encircling means extending toward and being anchored to said faceplate, whereby loading forces exerted upon the insert and the surrounding cast material of the cast member are distributed over surfaces of said encircling means and faceplate in contact with said cast material.

2. The apparatus of claim 1 wherein said faceplate is substantially flush with one external surface of the cast member.

3. The apparatus of claim 1 wherein said encircling means is welded to said faceplate.

4. The apparatus of claim 1 wherein said encircling means comprises an elongated rod having an intermediate portion encircling said insert.

5. The apparatus of claim 1 wherein said encircling means comprises an elongated rod and a flat plate joined together to encircle the insert.

6. The apparatus of claim 5 wherein said flat plate is joined to said faceplate.

7. The apparatus of claim 6 wherein said flat plate and said rod are joined together by welding and said flat plate and said face plate are joined together by welding.

8. The apparatus of claim 6 wherein said flat plate is arranged along an underside of said insert to support the insert so that said insert lies adjacent to a major face of said flat plate.

9. The apparatus of claim 1 wherein said insert has a substantially keyhole-shaped opening, said faceplate having an opening conforming to said substantially keyhole-shaped opening.

10. The apparatus of claim 9 wherein a square-shaped portion of the keyhole-shaped opening in said insert extends into a square-shaped portion of the keyhole-shaped opening in said face plate.

11. The apparatus of claim 1 wherein said insert has a closed end, a hollow locking pin receiving portion adjacent said closed end, and being of an enlarged diameter relative to an intermediate portion of said insert adjacent to said locking pin receiving portion to form an exterior shoulder between said closed end and intermediate portion;

said encircling means including a rod at least partially encircling the insert and having a portion lying adjacent to said exterior shoulder.

12. In combination, a cast member and a lift pin receiving assembly, said cast member being formed of a cementitious material, and having a given thickness;

said lift pin receiving assembly being embedded in said cast member and comprising a hollow plastic insert having a closed end and an open end;

the open end of said insert having a keyhole-shaped configuration;

a faceplate having one major surface which is substantially flush with an external surface of said cast member; said faceplate having an opening conforming in shape to the keyhole-shaped open end of said insert, said faceplate opening and said keyhole-shaped open end being accessible from said external surface;

support means surrounding a portion of said insert being joined to said faceplate, whereby a lifting force applied to said cast member by a horizontally aligned lifting pin positioned in said insert is distributed over a surface area of said support means and a surface of said faceplate engaging said cementitious material.

13. The apparatus of claim 12 wherein said support means is welded to said faceplate.

14. The apparatus of claim 12 wherein said support means comprises an elongated rod having an intermediate portion encircling said insert.

15. The apparatus of claim 14 wherein said elongated rod is bent into a U-shaped form.

16. In combination, a cast member and a lift pin receiving assembly, said cast member being formed of a cementitious material, and having a given thickness;

said lift pin receiving assembly being embedded in said cast member and comprising a hollow plastic insert having a closed end and an open end;

the open end of said insert having a keyhole-shaped configuration;

a faceplate having one major surface which is substantially flush with an external surface of said cast member; said faceplate having an opening conforming in shape to the keyhole-shaped open end of said insert, said faceplate opening and said keyhole-shaped open end being accessible from said external surface;

support means at least partially surrounding a portion of said insert being joined to said faceplate, whereby a lifting force applied to said cast member by a horizontally aligned lifting pin positioned in said insert is distributed over a surface area of said support means and a surface of said faceplate engaging said cementitious material; said support means comprising an elongated rod and a flat plate joined together to encircle the insert.

17. The apparatus of claim 12 further comprising a U-shaped rebar having its free ends welded to said face plate, a free curved end of said rebar engaging a shoulder of said insert, said U-shaped rebar and flat plate retaining said insert therebetween.

18. The apparatus of claim 12 wherein said insert has a closed end, a hollow locking pin receiving portion adjacent said closed end, and being of an enlarged diameter relative to an intermediate portion of said insert adjacent to locking pin receiving portion to form an exterior shoulder between said closed end and said intermediate portion;

said rod at least partially encircling the insert and having a portion lying adjacent to said shoulder.

19. The apparatus of claim 16 wherein portions of arms of the U-shaped rod are welded to adjacent sides of the flat plate.

20. The apparatus of claim 16 wherein said flat plate is joined to said faceplate.

21. The apparatus of claim 20 wherein said flat plate and said rebar are joined together by welding and said flat plate and said face plate are joined together by welding.

22. The apparatus of claim 20 wherein said flat plate is arranged along an underside of said insert so that said insert lies adjacent to a major face of said flat plate.

23. The apparatus of claim 20 wherein said flat plate is arranged adjacent to an underside of said insert so that said insert lies immediately adjacent an edge of said flat plate.

24. In combination, a cast member and a lift pin receiving assembly, said cast member being formed of a cementitious material, and having a given thickness;

said lift pin receiving assembly being embedded in said cast member and comprising a hollow plastic insert having a closed end and an open end;

the open end of said insert having a keyhole-shaped configuration;

a faceplate having one major surface which is substantially flush with an external surface of said cast member; said faceplate having an opening conforming in shape to the keyhole-shaped open end of said insert, said faceplate opening and said keyhole-shaped open end being accessible from said external surface;

support means at least partially surrounding a portion of said insert being joined to said faceplate, whereby a lifting force applied to said cast member by a horizontally aligned lifting pin positioned in said insert is distributed over a surface area of said support means and a surface of said faceplate engaging said cementitious material; a spacer plate arranged on said flat plate, an undersurface of said insert resting upon an exposed surface of said spacer plate.

25. A method for producing an insert assembly for embedment in cast members said insert assembly including a hollow insert member having a keyhole-shaped open end and a portion adjacent a closed end thereof, said method comprising the steps of:

(a) providing a flat, rigid faceplate;

(b) forming a keyhole-shaped opening in said faceplate conforming to the keyhole-shaped open end of said insert;

(c) providing an elongated rebar;

(d) bending said rebar to form a loop about an intermediate portion of said insert and having free ends of said bar joined to said loop arranged in spaced parallel fashion;

(e) inserting the free ends of said rebar into openings provided in said faceplate;

(f) welding the free ends of said rebar to said faceplate;

(g) providing a second elongated rebar;

(h) bending said second rebar into an L-shaped form;

(i) inserting said insert into said loop formed by said first rebar and moving a square-shaped portion of the keyhole-shaped opening into a square-shaped portion of the keyhole-shaped opening in said faceplate; and (j) inserting a free end of one arm of said L-shaped rebar into a third opening provided in said faceplate whereby a remaining arm of said L-shaped rebar is positioned adjacent to the closed end of said insert.

26. A method for producing an insert assembly for embedment in cast members and the like said insert assembly including a hollow insert member having a key-hole shaped open end and a portion adjacent a closed end thereof, said method comprising the steps of:

(a) providing a flat, rigid faceplate;

(b) forming a keyhole-shaped opening in said faceplate conforming to the keyhole-shaped open end in said insert;

(c) providing a flat, rigid support plate;

(d) welding one end of said flat support plate to one major surface of said faceplate;

(e) providing an elongated rebar;

(f) bending said elongated rebar into a substantially U-shaped configuration have two free ends;

(g) welding portions of the free ends of said U-shaped rebar to said flat support plate so that said U-shaped rebar and flat support plate cooperate to form an encircling opening;

(h) inserting said insert through said encircling opening so that a square-shaped portion of the key-hole shaped open end said insert is inserted into a square-shaped portion of the keyhole-shaped opening in said faceplate.

27. The method of claim 26 wherein step (d) further includes the step of orienting the flat support plate so that a major face thereof is positioned adjacent an undersurface of said insert when said insert is properly oriented with its square-shaped portion inserted in the square-shaped portion of the keyhole-shaped opening in said faceplate.

28. The method of claim 26 wherein step (d) further includes the step of orienting the flat support plate so that an edge thereof adjacent to an edge thereof joined to said faceplate is positioned adjacent to an underside of said insert when said insert is properly positioned with the square-shaped portion of its keyhole-shaped open end inserted into the square-shaped portion of the keyhole-shaped opening in said faceplate.

* * * * *

UNITED STATES PATENT AND TRADEMARK OFFICE

CERTIFICATE OF CORRECTION

PATENT NO. : 5,860,254

DATED : January 19, 1999

INVENTOR(S) : Westhoff et al

It is certified that error appears in the above-identified patent and that said Letters Patent is hereby corrected as shown below:

Col. 9, line 35, delete "case" and insert --cast--.

Signed and Sealed this

Twenty-first Day of November, 2000

*Attest:*

Q. TODD DICKINSON

*Attesting Officer*

*Director of Patents and Trademarks*